US012618576B2

(12) United States Patent
Wilson et al.

(10) Patent No.: US 12,618,576 B2
(45) Date of Patent: May 5, 2026

(54) AIR PURIFIER

(71) Applicant: Airea, LLC, Chicago, IL (US)

(72) Inventors: Scott H. Wilson, Chicago, IL (US); Gary H. Paulsen, Chicago, IL (US); D. Matthew Puhalla, Glen Ellyn, IL (US)

(73) Assignee: AIREA, LLC, Chicago, IL (US)

( * ) Notice: Subject to any disclaimer, the term of this patent is extended or adjusted under 35 U.S.C. 154(b) by 420 days.

(21) Appl. No.: 18/328,559

(22) Filed: Jun. 2, 2023

(65) Prior Publication Data

US 2024/0401824 A1 Dec. 5, 2024

(51) Int. Cl.

| | |
|---|---|
| ***F24F 8/22*** | (2021.01) |
| ***F24F 8/30*** | (2021.01) |
| ***F24F 8/80*** | (2021.01) |
| ***F24F 13/20*** | (2006.01) |
| *F24F 8/108* | (2021.01) |

(52) U.S. Cl.

CPC ..... *F24F 8/22* (2021.01); *F24F 8/30* (2021.01); *F24F 8/80* (2021.01); *F24F 13/20* (2013.01); *F24F 8/108* (2021.01); *F24F 2013/205* (2013.01); *F24F 2013/207* (2013.01)

(58) Field of Classification Search

CPC ..... F24F 8/22; F24F 8/30; F24F 8/80; F24F 13/20; F24F 8/108; F24F 2013/205; F24F 2013/207

See application file for complete search history.

(56) References Cited

U.S. PATENT DOCUMENTS

| | | | | |
|---|---|---|---|---|
| 6,238,631 | B1 * | 5/2001 | Ogata | F01N 3/2803 422/186.3 |
| 6,315,963 | B1 * | 11/2001 | Speer | B01J 19/123 210/748.14 |
| 7,935,311 | B2 * | 5/2011 | Katayama | A61L 9/18 422/120 |
| 7,988,923 | B2 * | 8/2011 | Fink | A61L 9/205 422/186.3 |
| 2004/0170537 | A1 * | 9/2004 | Hara | A61L 9/205 422/121 |

(Continued)

FOREIGN PATENT DOCUMENTS

| | | | |
|---|---|---|---|
| CN | 101773767 A | * | 7/2010 |
| CN | 202126034 U | * | 1/2012 |

(Continued)

OTHER PUBLICATIONS

EPO translation of CN104061627 (Year: 2014).*

(Continued)

*Primary Examiner* — Stephen Hobson
(74) *Attorney, Agent, or Firm* — Miller Nash LLP

(57) ABSTRACT

Air purification devices are disclosed that cleanse air of germs and microbes through an oxidation process using an ultraviolet light source that causes a chemical reaction with a proximate catalyst-coated surface. The devices use a replaceable ionization cell folded into a core assembly and positioned around the ultraviolet light source. The ionization cell is coated with the reactive catalyst on at least an inner surface facing the light source and air is cleansed as it passes through the ionization cell. The devices provide safety mechanisms to protect against human exposure to the ultraviolet light.

5 Claims, 15 Drawing Sheets

(56) References Cited

U.S. PATENT DOCUMENTS

| | | | | |
|---|---|---|---|---|
| 2005/0008549 | A1* | 1/2005 | Hsu | A61L 9/205 422/186 |
| 2005/0186124 | A1* | 8/2005 | Fink | A61L 9/205 422/121 |
| 2008/0310993 | A1* | 12/2008 | Katayama | B01J 35/39 422/4 |
| 2010/0209312 | A1* | 8/2010 | Pastor | A61L 9/205 422/186 |
| 2012/0128539 | A1* | 5/2012 | Gross | A61L 9/205 422/121 |
| 2018/0185539 | A1* | 7/2018 | Keith | A61L 9/205 |
| 2022/0362432 | A1* | 11/2022 | Higgins | F24F 11/30 |
| 2024/0399017 | A1* | 12/2024 | Wilson | F24F 8/22 |

FOREIGN PATENT DOCUMENTS

| | | | | | |
|---|---|---|---|---|---|
| CN | 102671597 | A | * | 9/2012 | |
| CN | 103212291 | A | * | 7/2013 | |
| CN | 104061627 | | * | 9/2014 | |
| CN | 104061627 | A | * | 9/2014 | |
| CN | 104832994 | A | * | 8/2015 | F24F 13/28 |
| CN | 104848427 | A | * | 8/2015 | F24F 13/24 |
| CN | 204768265 | U | * | 11/2015 | |
| CN | 205948667 | U | * | 2/2017 | |
| CN | 106669412 | A | * | 5/2017 | B01D 53/44 |
| CN | 107084451 | A | * | 8/2017 | F24F 3/14 |
| CN | 207152902 | U | * | 3/2018 | |
| CN | 208177249 | U | * | 12/2018 | |
| CN | 208275131 | U | * | 12/2018 | |
| CN | 208579436 | U | * | 3/2019 | |
| CN | 106268311 | B | * | 7/2019 | B01D 53/885 |
| CN | 110152484 | A | * | 8/2019 | B01D 53/007 |
| CN | 210457577 | U | * | 5/2020 | |
| CN | 111229028 | A | * | 6/2020 | B01D 53/86 |
| CN | 112611051 | A | * | 4/2021 | F24F 3/16 |
| CN | 113339932 | A | * | 9/2021 | F24F 8/22 |
| CN | 214426153 | U | * | 10/2021 | |
| CN | 215751819 | U | * | 2/2022 | |
| CN | 114941885 | A | * | 8/2022 | F24F 8/167 |
| CN | 219283559 | U | * | 6/2023 | |
| DE | 102014009527 | A1 | * | 12/2015 | C02F 1/325 |
| GB | 2596087 | A | * | 12/2021 | B01D 53/885 |
| JP | 2000070355 | A | * | 3/2000 | |
| JP | 5290676 | B2 | * | 9/2013 | |
| JP | 6704297 | B2 | * | 6/2020 | |
| KR | 10142332 | | * | 7/2014 | |
| KR | 101423325 | B1 | * | 7/2014 | |
| WO | WO-2007138172 | A1 | * | 12/2007 | B01D 53/007 |
| WO | WO-2011070206 | A1 | * | 6/2011 | B01J 35/39 |
| WO | WO-2024249919 | A1 | * | 12/2024 | B01D 53/885 |

OTHER PUBLICATIONS

EPO translation of JP-5290676-B2 (Year: 2013).*
EPO translation of KR 10142332 (Year: 2014).*
International Search Report and Written Opinion of the International Searching Authority issued in International Application No. PCT/US2024/032084, mailed Jul. 29, 2024, 13 pgs.

* cited by examiner

AIR PURIFIER

TECHNICAL FIELD

This invention relates generally to air purification systems, and more specifically, to air purification systems and devices that use ultraviolet light to induce oxidation to destroy germs, microbes and other small airborne pathogens.

BACKGROUND

Air purifiers are a known tool for not only removing odors but also for helping to sterilize and cleanse the air in a room. They have become more prevalent and in demand after the recent COVID-19 pandemic, and as there are more concerns over airborne pathogens. The simplest and traditional form of an air purifier is simply a fan and a filter captured within a housing. The fan draws air in, passes it through a filter to remove dust and other larger particles, and circulates the cleaner air back out into the room. Essentially all residential and commercial HVAC systems include serviceable/replaceable air filters that perform this air cleaning function. However, filters only catch larger particles and do nothing to halt the spread of smaller microbes, viruses, and bacteria.

To cleanse the air of these smaller particles, a process of oxidation can be performed. Oxidation is a chemical reaction that combines a substance with oxygen to change its properties. This chemical reaction can be used to kill or render inert bacteria, mold, viruses and other small harmful products that may exist in residential or commercial room air. While oxidation occurs naturally in the presence of sunlight, air and water, it can be greatly accelerated in the confines of an air purification device using a process called photohydroionization or "PHI." PHI is a rapid, forced oxidation process where broad spectrum ultraviolet light is cast upon a hydrophilic surface coated with a catalyzing agent that absorbs moisture from the surrounding air to produce hydrogen peroxide ions. These ions quickly break down into water and air, and in the process reduce air pollutants and neutralize viruses. An example of this process is disclosed in U.S. Pat. No. 7,988,923 to Fink, which is incorporated herein by reference in its entirety. Though other agents can be used, Fink discloses use of a "quad metallic" catalyzing agent on the hydrophilic surface that includes titanium oxide (TiO2), copper, sulfur and rhodium combined with a hydrating agent such as silica gel.

PHI has been harnessed and used in large, industrial air purification systems, and has proven effective at reducing or eliminating deadly viruses such as SARS-COV-1 (protein jacketed), H1N1 (Swine Flu), H5N1 (Bird flu), as well as to quickly and effectively remove odors in the air. However, it has not been harnessed in a suitable residential air purification device. This is, at least in part, because of the cost and maintenance requirements of traditional systems, as well as the hazards from the ultraviolet light source itself, which is very bright and can be harmful to the human eye and skin. What is needed is a practical design that brings this process of photohydroionization within reach of the common consumer.

SUMMARY OF THE INVENTION

The present invention provides for air purification systems and devices that provide photohydroionization in a consumer-friendly form that is capable of both protecting users from harmful UV light exposure and cleansing a large amount of room air with a compact device that is easily serviced.

In some embodiments, the air purification system includes air purification unit with an ultraviolet light source and an ionization cell having an inner surface coated with a catalyst. The inner surface forms a series of ridges and valleys where each valley has at least one foldable seam that allows the ionization cell to fold at least partially around the ultraviolet light source. A fan assembly is positioned to create an airflow along the inner surface of the ionization cell. The ionization cell may be fitted within a rigid sleeve that fits into a housing to position it around the ultraviolet light source. The air purification unit may include a base structure for housing the fan and containing a motor and electric source for powering the fan. The base structure may be configured to allow air to flow in through the fan and through the ionization cell. An opaque removable cover may be placed over the ionization cell to block exposure to ultraviolet light.

In other embodiments, the air purification system includes an air purification unit having an air inlet, an air outlet separated a distance from the air inlet, and an ultraviolet light source positioned along a length of the distance. The unit has a removable ionization cell with an inner surface coated with a catalyst and an outer surface, where the removable ionization cell has an unfolded position in which the outer surface is substantially flat and a folded position in which the inner surface is configured to substantially surround the ultraviolet light source. The unit may include a fan to move air along the ionization cell, and may include a switch to control the flow of electricity to the ultraviolet light source, wherein the switch only allows the flow of electricity to the ultraviolet light source when a substantially opaque removable cover is fit over the ultraviolet light source.

In still other embodiments, the air purification system includes an air purification unit with a base structure, a removable outer cover configured to fit to the base structure, an ultraviolet light source connected to the base structure, and an ionization cell positioned substantially surrounding the ultraviolet light source, the ionization cell having an inner surface facing the ultraviolet light source and an outer surface facing away from the ultraviolet light source, wherein the inner surface is coated with a catalyst and forms a series of ridges and valleys such that the ridges extend toward the ultraviolet light source and the valleys extend away from the ultraviolet light source. The ionization cell may have at least one foldable seem along at least one valley such that, when the ionization cell is removed from the air purification unit, it can be unfolded along the at least one foldable seam.

As will be understood and appreciated by those of skill in the art from a review of the full written description below, variations may be made to the component configurations described above in some embodiments, and additional components may be used in some particular embodiments. For example, some embodiments may be incorporated into a mobile air purifier unit designed to sit on a table or in a fixed air purifier unit designed to be mounted to a wall. Still other embodiments and/or features are identified in the disclosure and claims below, in combination with the associated figures.

BRIEF DESCRIPTION OF THE DRAWINGS

The present invention can be better understood with reference to the following drawings. The components in the drawings are not necessarily to scale, emphasis instead being placed upon clearly illustrating the principles of the present invention. Where dimensions are provided, they are used for reference and understanding, and are not limiting unless the feature in question expressly claimed to be of a particular dimension. In the drawings, like reference numerals designate corresponding parts throughout the several views.

DETAILED DESCRIPTION

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

The air purification units described herein may take on various physical forms and still fall within the scope of the claims set forth herein. For purposes of example, a subset of possible formats are disclosed. The units may be portable or fixed in position, depending on the physical form and other characteristics such as disclosed herein. One of ordinary skill in the art of mechanical systems will understand that the size of the exemplary embodiments disclosed, and of the air purification units claimed, are scalable. That is, a larger unit would be able to cleanse a larger volume of air in a given period of time than a smaller unit. Moreover, larger or smaller units could be built based on the teachings herein simply by scaling the components of the unit, such as the ultraviolet light source, the fan, and the core assembly, as discussed further below. Testing shows that a unit having a core assembly 120 mm in length can sufficiently cleanse the air in an 800 square foot room with a standard 8-foot ceiling.

Figure 1:
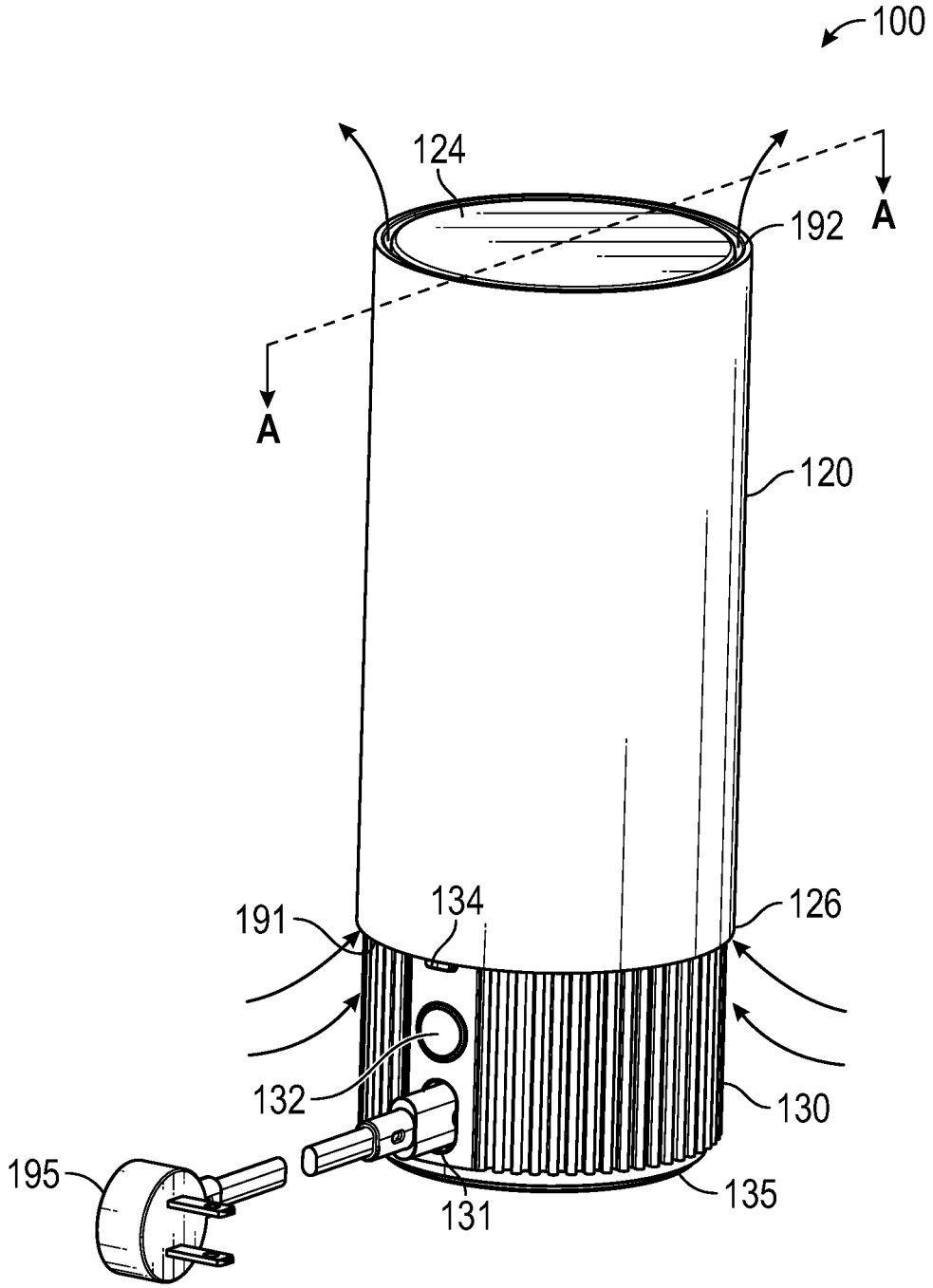
FIG. 1 is a perspective view of an air purification unit in accordance with the present invention.

FIG. 1 shows a perspective view of an air purification unit 100 in accordance with particular embodiments of the present invention. The air purification unit 100, also referred to herein as the "mobile unit," features a base structure 130 and an outer cover 120 that come together to form an interior housing. As will be discussed, it is helpful for both of these components to be essentially opaque so as to prevent external exposure to the ultraviolet light source contained within. Arrows show that, in this particular embodiment, room air is pulled up under the lower perimeter 126 of the outer cover 120 and eventually exits out air outlets 192 formed in a top surface of the cover 120. As will be explained, it is between this lower perimeter 126 and the air outlets 192 that the air is exposed to and cleansed by hydrogen peroxide ions.

Air purification unit 100 is designed to be a portable embodiment that can be placed on a table (typically smaller units) or on the floor (typically larger units). It requires a power source, which in this case is supplied by an electrical cable 195 that plugs into a standard wall outlet. The other end of the cable 195 plugs into a power receptacle 131 near the bottom of the base structure 130. The air purification unit sits on a bottom surface 135 of the base structure 130. In some embodiments, the base structure 130 may alternatively or additionally house a battery pack that may store electricity such that the air purification unit 100 may operate temporarily in the absence of external power. It will be understood that the unit 100 could alternatively be powered via an adapter via a USB port, a cigarette lighter of a vehicle, or other common power source.

Air purification unit 100 is further equipped with a power button 132 for turning the unit "on" by supplying electricity to the internal components. Alternatively or additionally, the unit 100 could contain an air quality sensor that determines when to automatically turn the unit on and off based on a variety of metrics such as air density, temperature, or the detection of certain types of dust or other particles in the air. Alternatively or additionally, the unit 100 could be equipped with a timer that causes the unit to operate during certain times of the day and for certain periods. In some instances, the operational timing could be adjusted manually by a user either via on-unit controls (not shown) or via a computer-based application that presents a control interface, such as on a user's mobile computer device (e.g., an i-phone from Apple). In such a case, the mobile computer device would convey instructions provided by the user to the air purification device via a wireless connection such as Bluetooth or the like, as is well known in the art of smart home appliances. In such cases, the air purification unit 100 would be further equipped with a receiver or transceiver for receiving and/or sending communications, such as via Bluetooth, from and/or to the mobile device.

Another feature of air purification unit 100 visible in FIG. 1 is the safety catch 134. Safety catch 134 functions as a toggle switch that controls the supply of electricity to an interior ultraviolet light source, as further shown below. When the outer cover 120 is installed over the base structure 130, the safety catch 134 is depressed, which allows power to reach the light source 160 (see FIG. 2) when the air purification unit 100 is powered on. When the outer cover 120 is removed, such as or servicing of the ionization cell 157 or to change the bulb 160, the safety catch 134 rises to a free position that causes electricity to the bulb to be cut off. This protects users and people nearby from being accidentally exposed to ultraviolet light when the outer cover 120 is removed and allows inspection of the unit 100 while still powered on.

Figure 2:
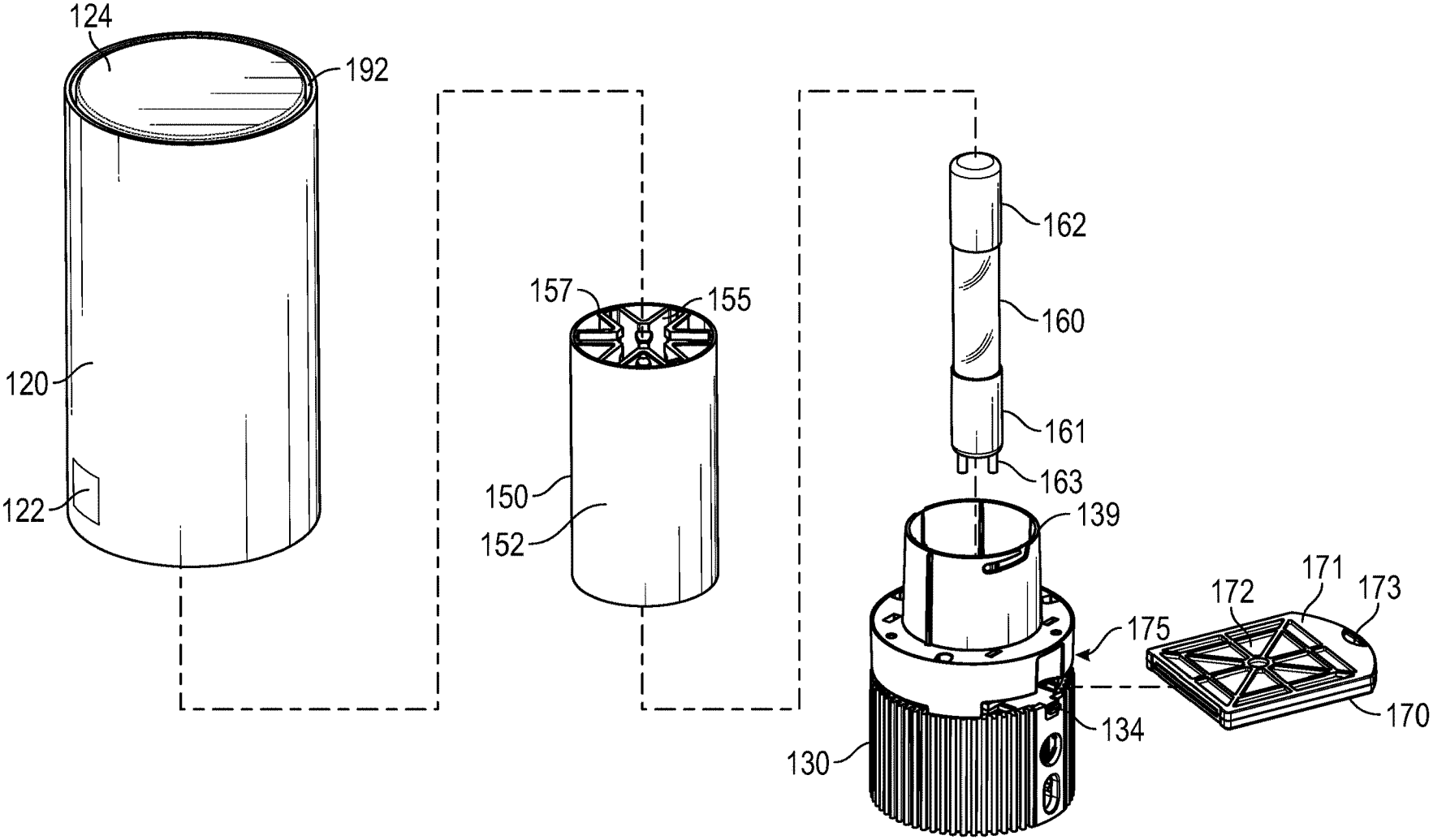
FIG. 2 is an exploded view of the air purification unit of FIG. 1, showing various internal components.

FIG. 2 shows an exploded view of the air purification unit 100 so as to expose various internal components. Outer cover 120 has been lifted away and is off to the right. As rotated in this view, label 122 is in view, which can simply be a brand label of the device. Base structure 130 has maintained position and is on the right, with bulb 160 extended above it. Because the outer cover 120 has been removed from the base structure 130, the safety catch 134 is in its free (raised) position, which again cuts power to the bulb 160. Bulb 160 serves as the ultraviolet light source in the illustrated embodiment. It will be understood that various ultraviolet light sources capable of producing light waves in the 200-300 nm wavelength range can be used. For example, bulb 160 is modeled after a four pin 250 UV light bulb designed for germicidal water treatment and made by Ultra Dynamics. As shown, bulb 160 has a bottom cap 161 and a top cap 162 that are generally opaque, and a center portion in between that is translucent (typically glass or clear plastic), such that light only emanates from the bulb 160 between the caps 161, 162.

The bulb 160 fits inside core assembly 150, which is further exploded above and away from the bulb in FIG. 2. As discussed further below, the core assembly contains a catalyst surface 155 on one side of an ionization cell 157 that wraps around the exposed center portion of bulb 160 when assembled. In operation, both the core assembly 150 and the bulb fit into core assembly housing 139 of the base structure, and the bulb 160 plugs into light receptacle 146.

Off to the right is a filter assembly 170 that operates like a filter in a standard air duct. When installed, the filter assembly 170 fits into the filter tray housing 175 carved out of the base structure 130. The filter assembly 170 can be positioned on either side of a fan (as shown below) and used to cleanse the air of larger inert particles, leaving only smaller viruses, microbes, odor-causing agents, etc., to pass through the core assembly 150. In some embodiments the air filter (and or the fan) may be located on the other side of the core assembly 150

Figure 3:
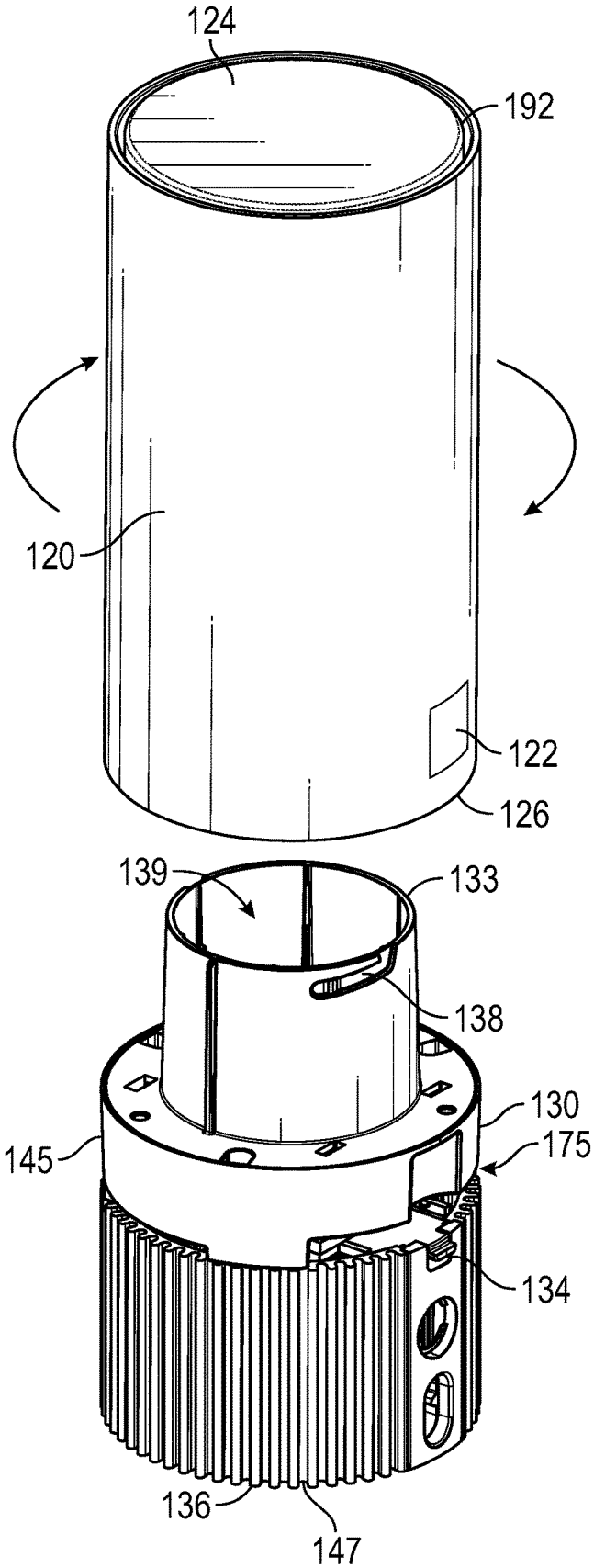
FIG. 3 is a perspective view of certain components of the air purification unit of FIG. 1, exploded to show how the components come together.

FIG. 3 is perspective view of the base structure 130 with the outer cover 110 removed extended above it. As shown, the base structure 130 features an upward extension that forms the core assembly housing 139. Cut into the outer surface of the upward extension is a rotational groove 138. As shown best in FIG. 4, these grooves correspond with protrusions 129 on the inside of the outer cover 120 such that the protrusions 129 fit into the grooves 138 to draw the outer cover 120 down over the base structure 130 into an assembled condition as it twists clockwise (see arrows). The lower perimeter 126 of the outer cover 120 will then press he safety catch 134 down so that the ultraviolet light source (bulb 160) can be engaged.

The lower perimeter 126 is large enough in diameter to fit down over the fan housing 145 of the base structure 130, and comes to rest just over the set of undulating ridges formed into the outer wall of the base structure 130. The ridges form a series of undulating base structure extensions 136 and protrusions 147 around the perimeter of base structure 130, which provide channels (along the protrusions) for the passage of room air up and under the lower perimeter 126 of the outer cover 10. The lower perimeter 126 has an inner diameter that approximately matches the distance from one base structure extension 136 laterally across to an opposing extension 136 on the far side of the base structure 130.

Figure 4:
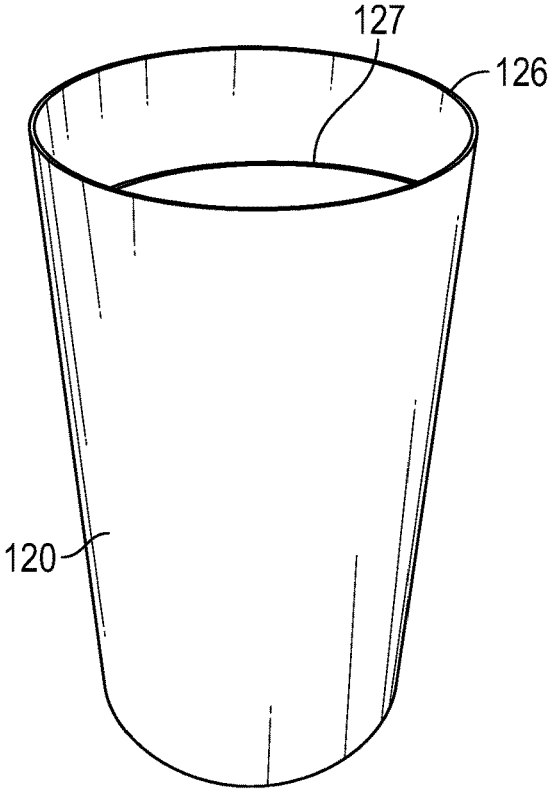
FIG. 4 is a perspective view of an opaque cover component of the air purification unit of FIG. 1 taken from a first side angle.
Figure 5:
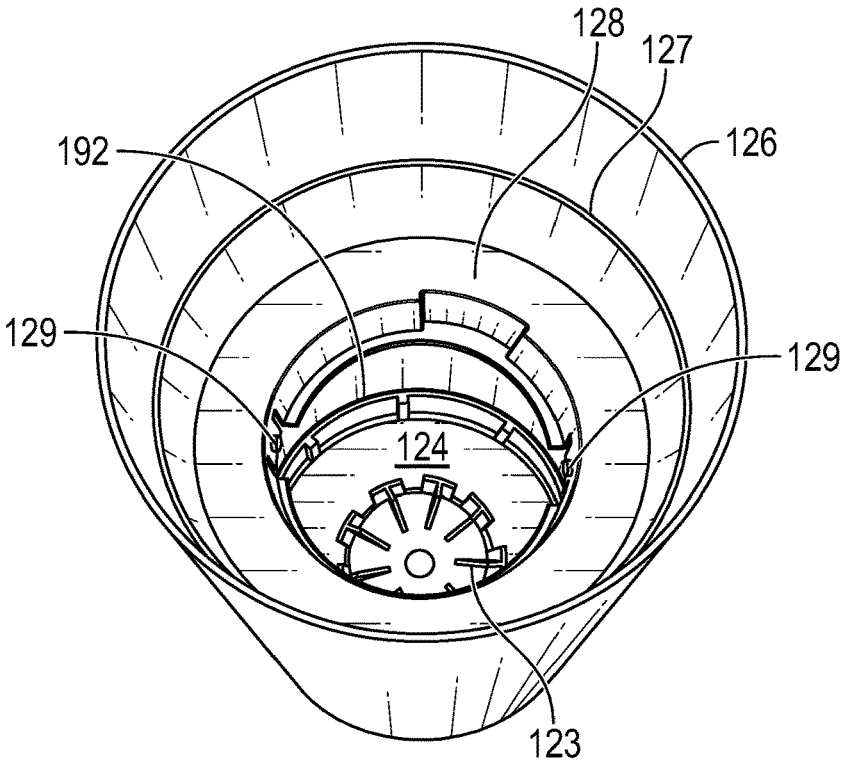
FIG. 5 is a perspective view of the opaque cover component shown in FIG. 4, but taken from a steeper side angle to show the interior thereof.

FIGS. 4 and 5 are perspective views of the removed outer cover 120, showing it at different angles to reveal its inside features. The features are formed to cooperate with corresponding features on the base structure 130 and core assembly 150. For example, lower step 127 seats against the upper surface of fan housing 145 when the outer cover 120 is twisted into place over the base structure 130. This helps close off air from escaping around the core assembly and generally helps create suction to pull it through the fan assembly 140 and up into the core assembly 150. Meanwhile, upper step 128, which is much wider than lower step 127, closes off around the outer perimeter of the extension that forms the core assembly housing 139 of the base structure 130. Again, this provides to close off air escape passageways and also provides for structural rigidity of the unit 100 when assembled.

In FIG. 5, additional features formed on the inside of the top surface 124 can be seen. These features include a series of cell spacers 123 that correspond to the shape of the ionization cell 157 (discussed below) when it is in its folded configuration. This helps securely hold the ionization cell in place within its sleeve 152. Again, a series of holes or slots form the air outlet 192 around the top perimeter of the outer cover 120.

Figure 6:
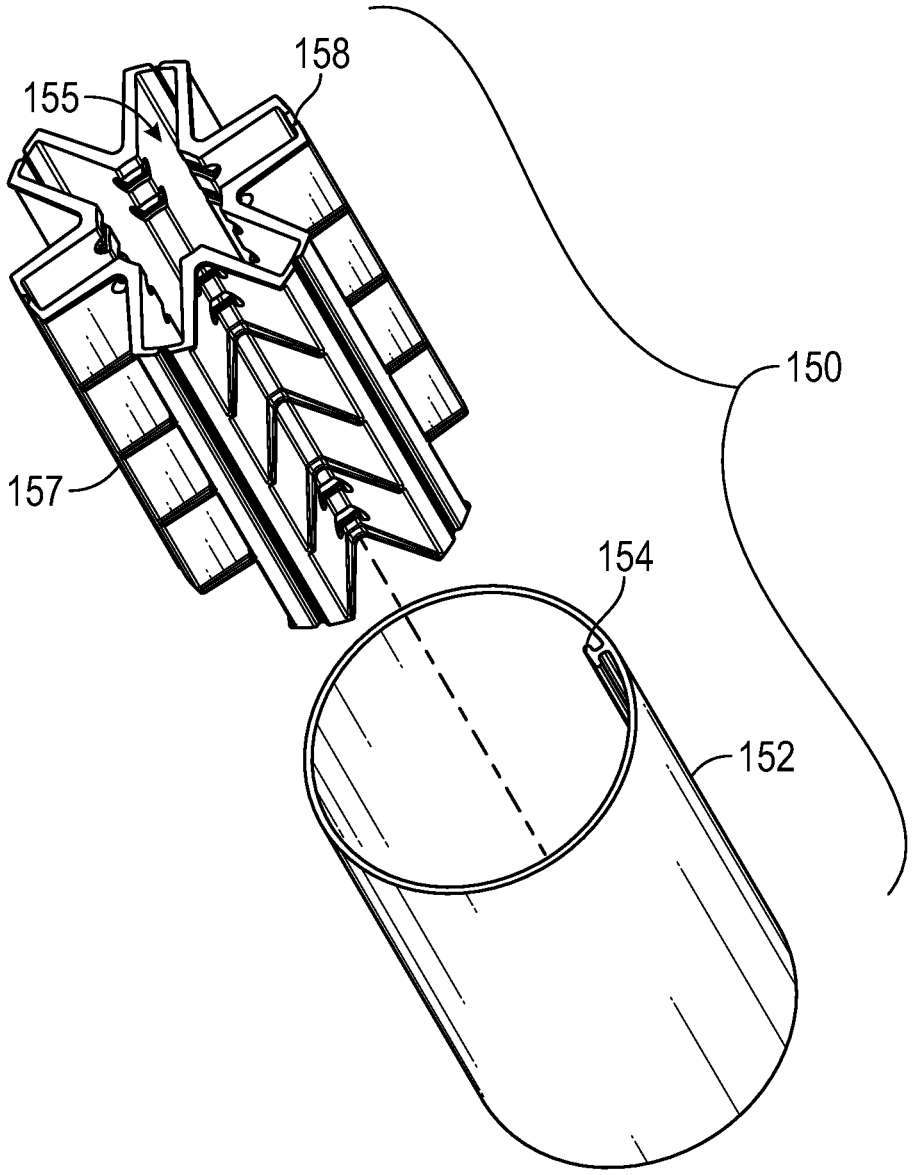
FIG. 6 is an exploded view of a core assembly of an air purification device, in accordance with an embodiment of the present invention.

FIG. 6 is an exploded isolation view of the core assembly, showing its two primary components the sleeve 152 and the ionization cell 157. The sleeve 152 is a rigid tube in which the ionization cell 157 is fit when in its folded configuration. While the cell spacers 123 on the inside surface of the outer shell 120 help hold the ionization cell 157 in place, the sleeve 152 features a rib 154 to help prevent rotation of the cell 157. As more clearly understood in view of FIGS. 7 and 8, the ionization cell 157 has first and second edges 151, 156 that come in close proximity when the ionization cell 157 is in its folded configuration, such that these edges 151, 156 fit underneath opposing sides of the rib 154 as the cell 157 is slid into the sleeve 152. FIG. 8 shows the ionization cell 157 assembled within the sleeve 152, and shows how the first and second edges 151, 156 fit along the rib 154.

The ionization cell 157 has a series of flexible seams 167, also called "living hinges," that allow the cell 157 to transition between a folded configuration or position and an unfolded configuration or position. The seams may be made of the same material as the rest of the ionization cell 157, but have a necked-down, thinner profile that allows for a high level of flexibility. For example, while scalable, the regular thickness of the ionization surfaces is preferably between 1 and 2 millimeters, while the thickness of the "living hinge" seam 167 is preferably between 0.3 to 0.5 millimeters.

Figure 7:
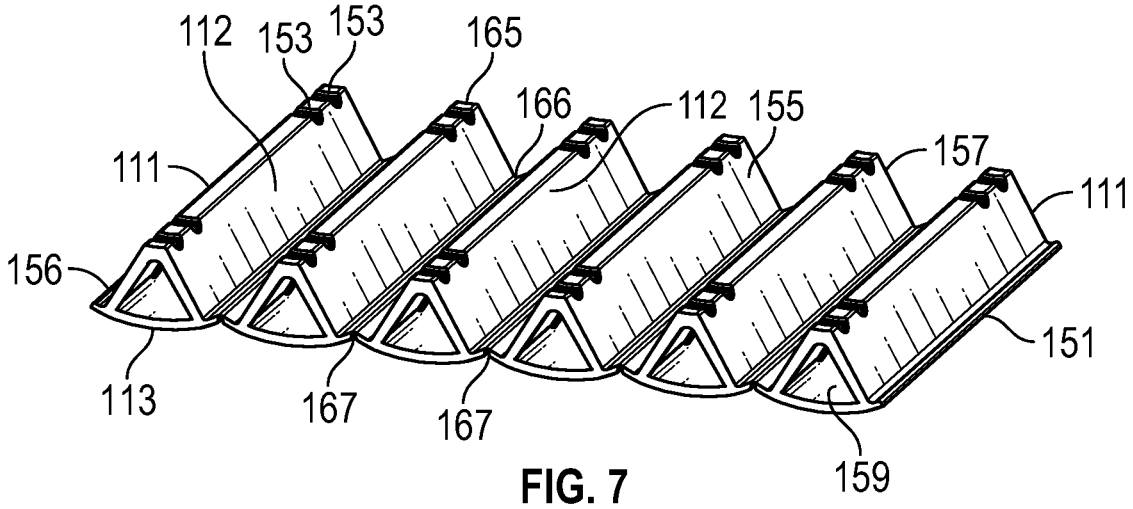
FIG. 7 is an isometric view of an ionization cell in an unfolded condition, in accordance with an embodiment of the present invention.
Figure 8:
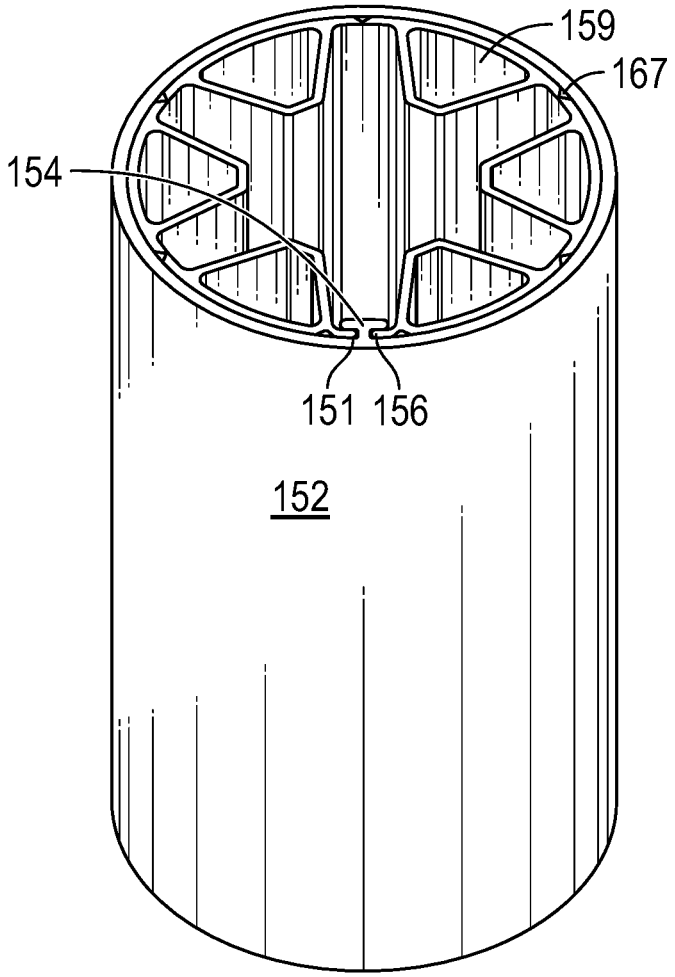
FIG. 8 is an isometric view of the core assembly of FIG. 6 in an assembled condition.

FIG. 7 shows the ionization cell 157 in its unfolded position. The ionization cell may be made of a semi-flexible material such as polycarbonate, polyamide or polypropylene. Other plastics, paper pulp or other natural and compostable materials could also be used. Material selection will ideally allow an increased level of flexibility at the seam 167 and a more firm shape for the remainder of the cell 157. For example, the cell 157 should hold its shape as it is inserted into or extracted from the sleeve 152. While manipulation of the seams 167 will typically be infrequent, the material and thickness should allow for hundreds of folds and unfolds without tearing. Also, the material must be able to withstand heat and radiation from the ultraviolet light source over long periods of time.

The ionization cell 157 is coated, at least on its upper surface (as shown in FIG. 7), with a catalyst designed to interact with high intensity ultraviolet light to prevent hydrogen peroxide ions and other oxidizing agents. An example of such a catalyst is the "quad metallic" coating described in Fink (U.S. Pat. No. 7,988,923), which consists of titanium oxide, copper, silver and rhodium. The foldable/unfoldable nature of the ionization cell 157 makes it very easy to consistently apply this coating during the manufacturing process, and avoid application on surfaces facing away from the UV light source where it has little or no value and is largely wasted. For example, the coating may be applied to ionization cell 157 with a spray process as opposed to dipping, which would coat the entire exterior surface.

In between each foldable seam 167 is a cell component 111 that features an upward-extending (in the unfolded position) or inward-extending (in the folded position) central ridge 165 and opposing slopes 112 falling away to either side of the ridge 165 into a trough 166 formed between each cell component 111. Each cell component 111 is hollow underneath the ridge 165, and has a backing element 113 that forms an arc connecting the two opposing slopes 112 and extending slightly beyond the slope ends to a foldable seam 167 on either side. When in the folded configuration, these backing elements 113 approximately form a cylinder with a diameter configured to fit inside the sleeve 152. Also in this configuration, the ridges 165 combine to form a relatively tight pocket for the UV bulb 160 to drop into (See FIG. 2). When installed, it is preferably to have only one to three millimeters of separation between the bulb 160 and the ridges 165. This design achieves the goal of presenting the catalyst very proximate to the UV light source, i.e., on the top of the ridges 165, while also maximizing catalyst-coated surface area exposed to the light, i.e., with the slopes 112 and troughs 166.

The hollow sections 159 formed by each cell component 111 allow for additional passage of air through the core assembly. Air passing through these sections 159 does not come into as intense contact with the oxidizing agents created by the UV light reacting with the surface coating, but does still get sufficiently ionized and allows for greater output and quieter operation. This is assisted by holes 153 positioned along the ridges 165 of the cell components 111, which allow air to pass back and forth on either side of the ridges and also allows hydrogen peroxide and other ionization elements to pass through to the backside of the ridges 165. This air exchange through the holes 153 also helps to dissipate heat generated by the bulb 160. In some embodiments, the ends of the hollow sections 159 and the holes 153 may be closed off such that essentially all airflow is passed through the troughs 166 that are hit directly with the UV light. However, it should be noted that even airflow not in contact with the UV light at all can still be sufficiently cleansed by the device because the ions and charged particles created travel through the air medium and are chemically attracted to organic compounds that within the air. Once attached to these compounds, the oxidation process takes place leaving them inert.

Figure 9:
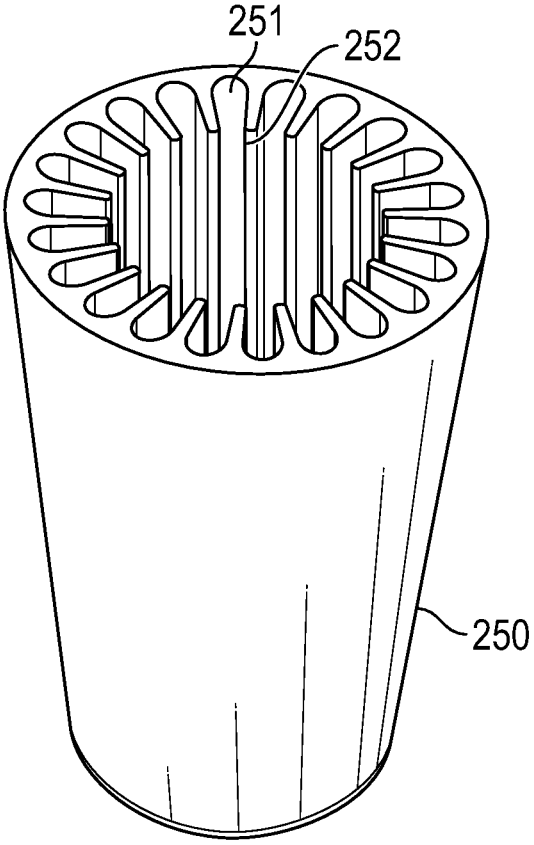
FIG. 9 is an isometric view of a core assembly in an assembled condition in accordance with an alternative embodiment.
Figure 9A:
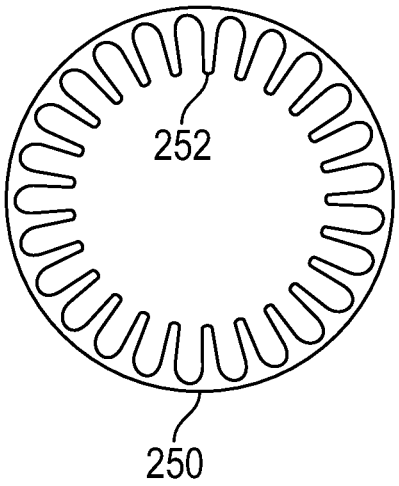
FIG. 9A is a top view of the core assembly of FIG. 9.

FIGS. 9 and 9A show an alternative design for a core assembly. Core assembly 250 may be formed as a one-piece design, and need not have a separate sleeve. Here, the core assembly has an interior surface featuring a number of oscillating troughs 251 and teeth 252 that are again designed to maximize catalyst-coated surface area exposed to the UV light source and to bring portions of the surface in closer proximity to said source. However, if a one-piece design, it is more difficult to consistently coat the inner surface of core assembly 250. A dipping process may be used, but then catalyst is largely wasted on the exterior surface. In some embodiments, core assembly 250 may have a parting line down one side such that it may be unrolled so that it can be sprayed with catalyst only along the inside surface, then rolled up and inserted into a rigid sleeve similar to sleeve 152 of FIG. 8.

Figure 10:
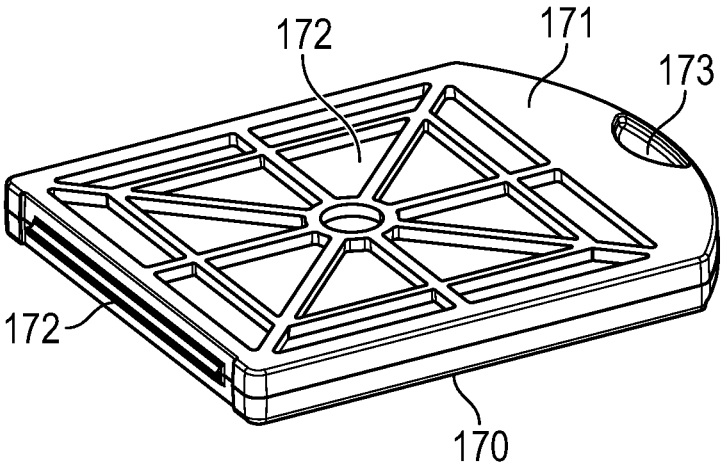
FIG. 10 is a perspective view of a filter assembly for an air purification device in accordance with certain embodiments of the present invention.

FIG. 10 illustrates a closeup view of the filter assembly 170 shown in FIG. 2. The filter assembly includes a filter tray 171 into which a filter medium 172 slides. The filter medium is a replaceable, membrane through which air can easily pass, but which collects and filters out larger particles such as dust, pollens, and fibrous materials within the air. The filter assembly has an extraction handle 173 that can be gripped by a user to remove it from the filter tray housing 175 (see FIG. 2) for replacement or cleaning. In the illustrated embodiment, the filter assembly 170 is positioned below the core assembly 150 and fan assembly 140. However, so long as it is positioned within the air pathway between the air inlets 191 and air outlets 192, the filter assembly can serve its purpose.

Figure 11:
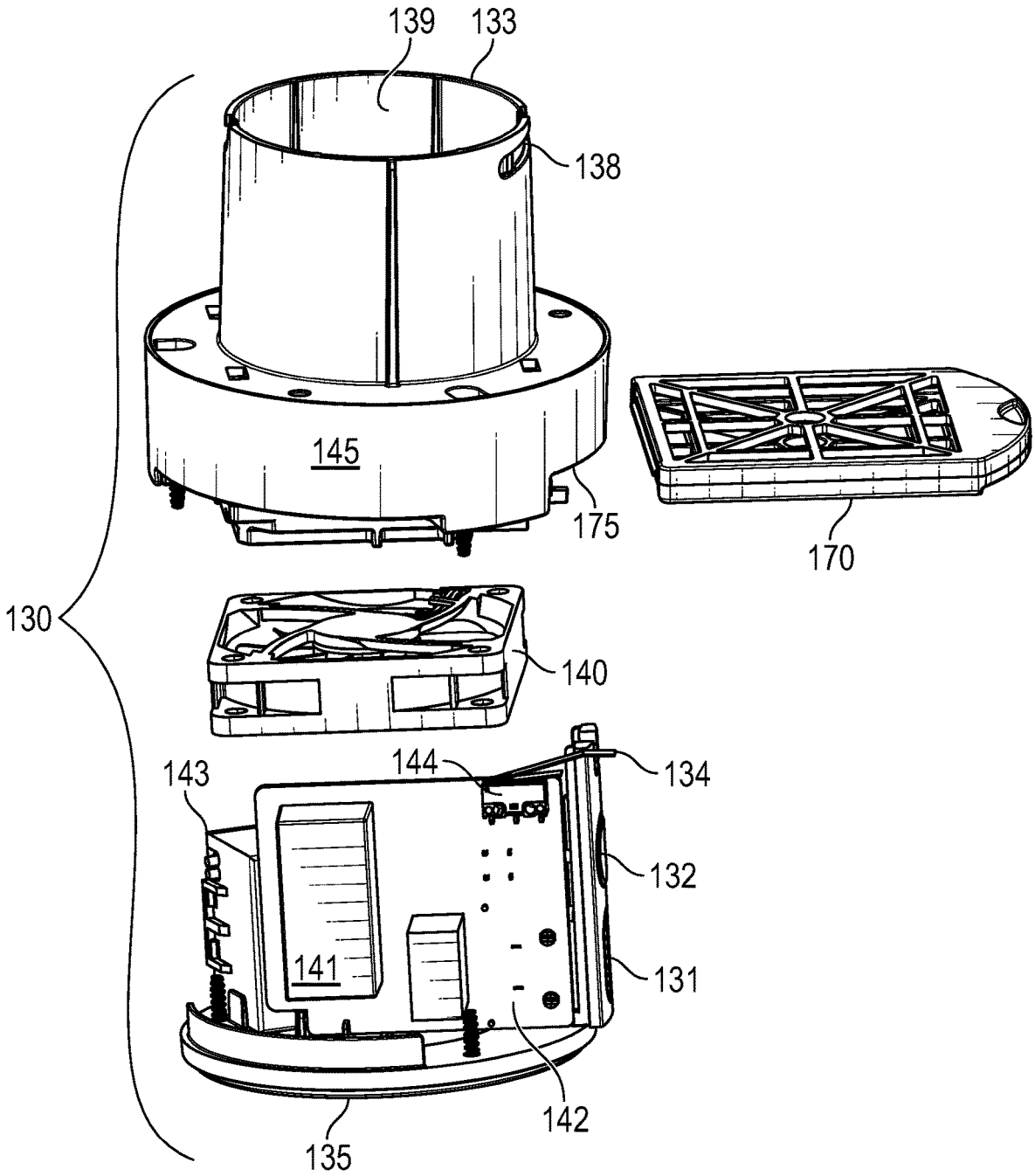
FIG. 11 is an exploded view of a base assembly of an air purification device in accordance with certain embodiments of the present invention.

FIG. 11 illustrates certain components of the base structure 130 according to the illustrated embodiment. Here, filter assembly 170 has been extracted from its housing 175, and the fan assembly 140 has been dropped down below the fan housing 145 where it is positioned when fully assembled. The top portion of the base structure 130 forms the core assembly housing 139 for receiving the core assembly 150 (not shown). Below the fan housing is the portion of the base structure 130 that packaged inside of the perimeter extensions 136 and protrusions 147 shown in FIG. 3. These components include a circuit board 142 that provides the electrical connections between the power receptacle 131, power button 132, light switch 144 and the fan motor 141. As shown, light switch 144 is connected to the safety catch 134, which, as described above, operates to cut power to the UV bulb 160 when the outer sleeve 120 is removed. The illustrated embodiment also includes a backup battery pack 143 for operation when not connected to a wall socket.

Figure 12:
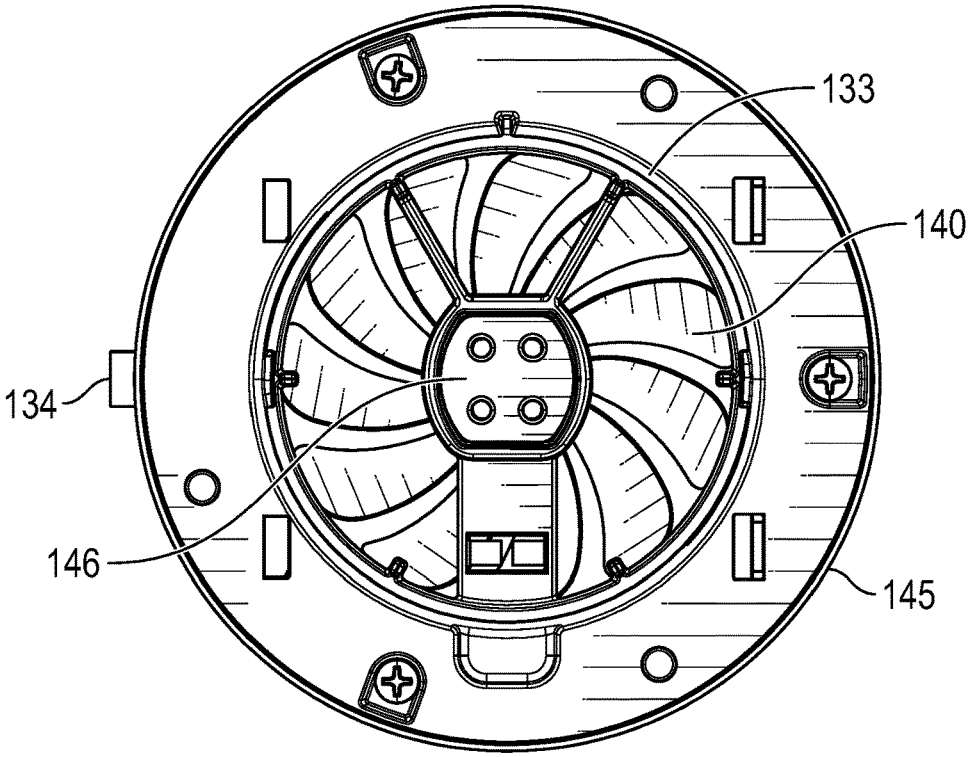
FIG. 12 is a bottom view of the base assembly of FIG. 11 in a fully assembled condition.
Figure 13:
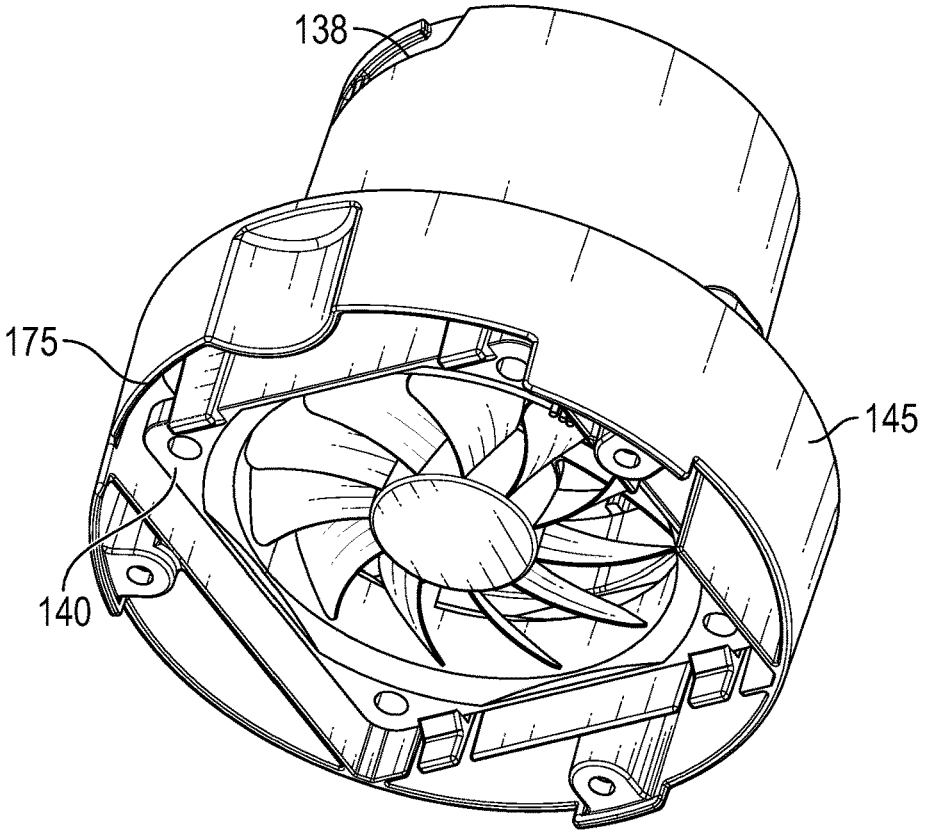
FIG. 13 is a perspective view of the base assembly of FIG. 12.

FIG. 12 shows a top view of the base structure 130 in isolation with the core assembly 150 and bulb 160 removed. The core assembly housing 139 lies within the upper rim 133, and is open at the bottom through which the fan assembly 140 is visible within fan housing 145. At the center is light receptacle 146. When installed, the pins 163 of bulb 160 fit into the light receptacle 146 to connect the bulb to a power source and hold it in position. FIG. 13 rotates this same isolated portion of the base structure 130 so as to view the bottom. This shows the fan assembly 140 installed up in the fan housing 145. The filter assembly 170 has been removed, but would slide in to filter tray housing 175 beneath the fan in the illustrated embodiment.

Figure 14:
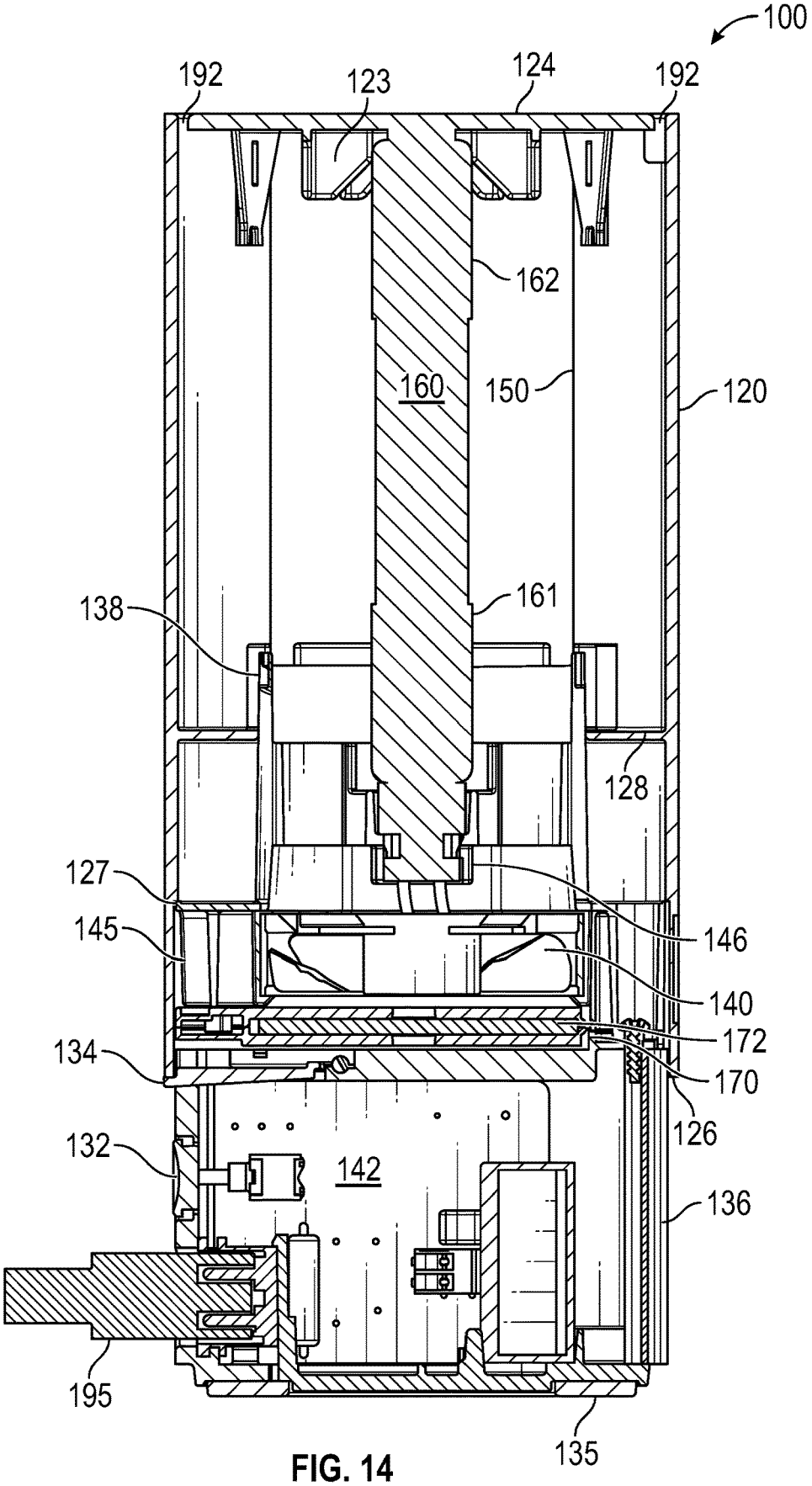
FIG. 14 is a section view of the air purification unit of FIG. 1, taken down the center of the unit along section line A.

FIG. 14 provides a section view down the center of the air purification device 100. This provide a view of all of the internal components in their assembled position. The air purification unit 100 sits on its bottom surface 135 and extends upward through the base structure that includes the circuit board 142 and other electrical components powered through electrical cable 195. Air passes in under the lower perimeter 126 of the outer cover 120, up through the filter medium 172, and through the fan assembly 140. It then continues up along the outside of bulb 160 and through the core assembly 150, eventually passing along the bottom of top surface 124 and out through air outlets 192.

FIGS. 15-19 show a different embodiment of an air purification unit that incorporates various concepts of the present invention. While the embodiment previously discussed is designed to be portable, the embodiment of FIGS. 15-19, referred to as a "wall unit," is generally intended to be mounted to a wall, ceiling or other fixed construction. Though having a completely different external shape and appearance, as will be seen, the "wall unit" shares many internal components with the mobile unit previously discussed.

Figure 15:
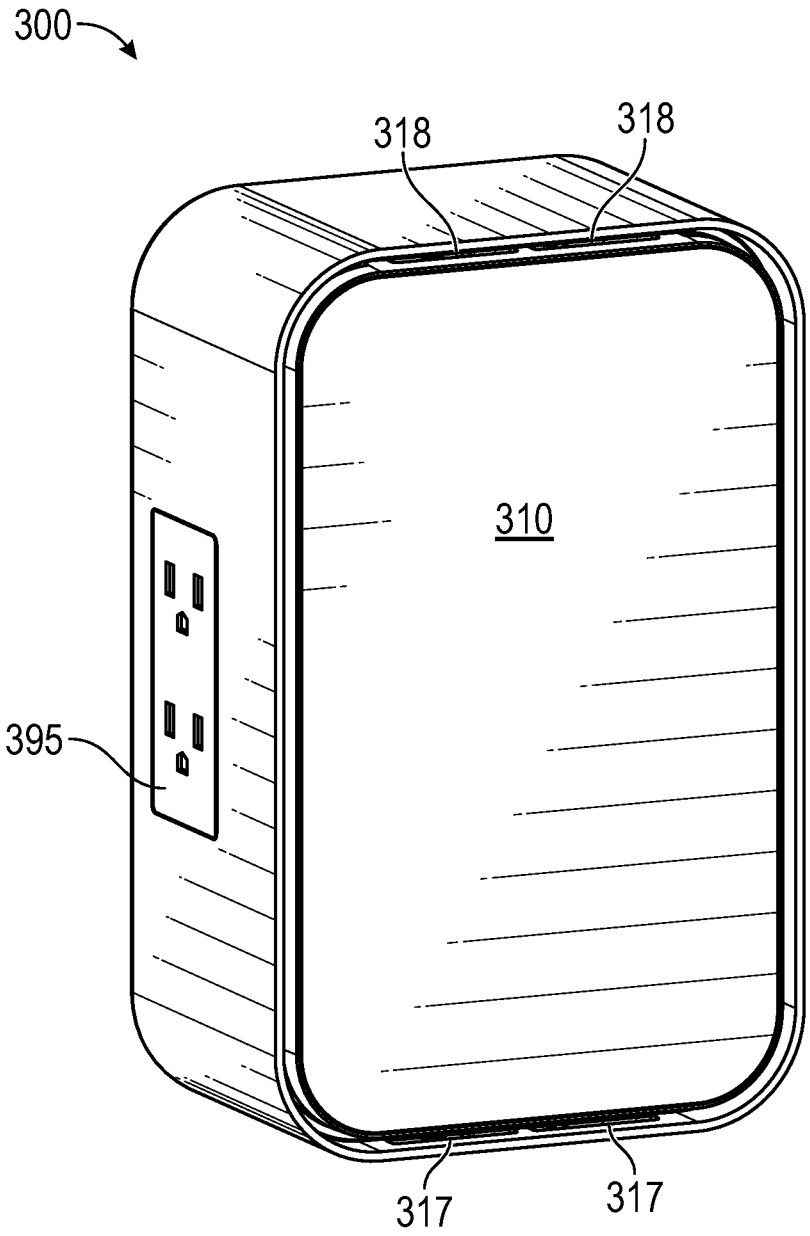
FIG. 15 is a front side perspective view of an air purification unit in accordance with another embodiment of the present invention.

As shown in FIG. 15, the "wall" air purifier unit 300 is of essentially rectangular construction, having a back panel 320, side walls providing for depth, and a face plate 310 on front. The face plate 310, which is substantially opaque and removable just like outer cover 120 of the previously discussed embodiment, is configured to fit inside the perimeter of the side walls of the unit 300. In the illustrated embodiment, the face plate 310 is held in place by magnets 315 (see FIG. 17) positioned on forward panels 312 of the unit 300. However, a variety of common mechanical fasteners could be used to attach and retain the fac plate, such as screws, clips, etc. At the bottom of the face plate 310 are a couple of air intake ports 317, and at the top of the face plate are a couple of air outlet ports 318. These ports could be of various sizes, shapes or quantities, the important aspect being that they allow for a generally uni-directional air flow through the air purifier unit 300. In order to help keep the air within the pathway from input to output, the face plate 310 may be equipped with foam inserts that seat up against the forward panels 312 (shown in FIG. 17) when the face plate is installed.

Figure 16:
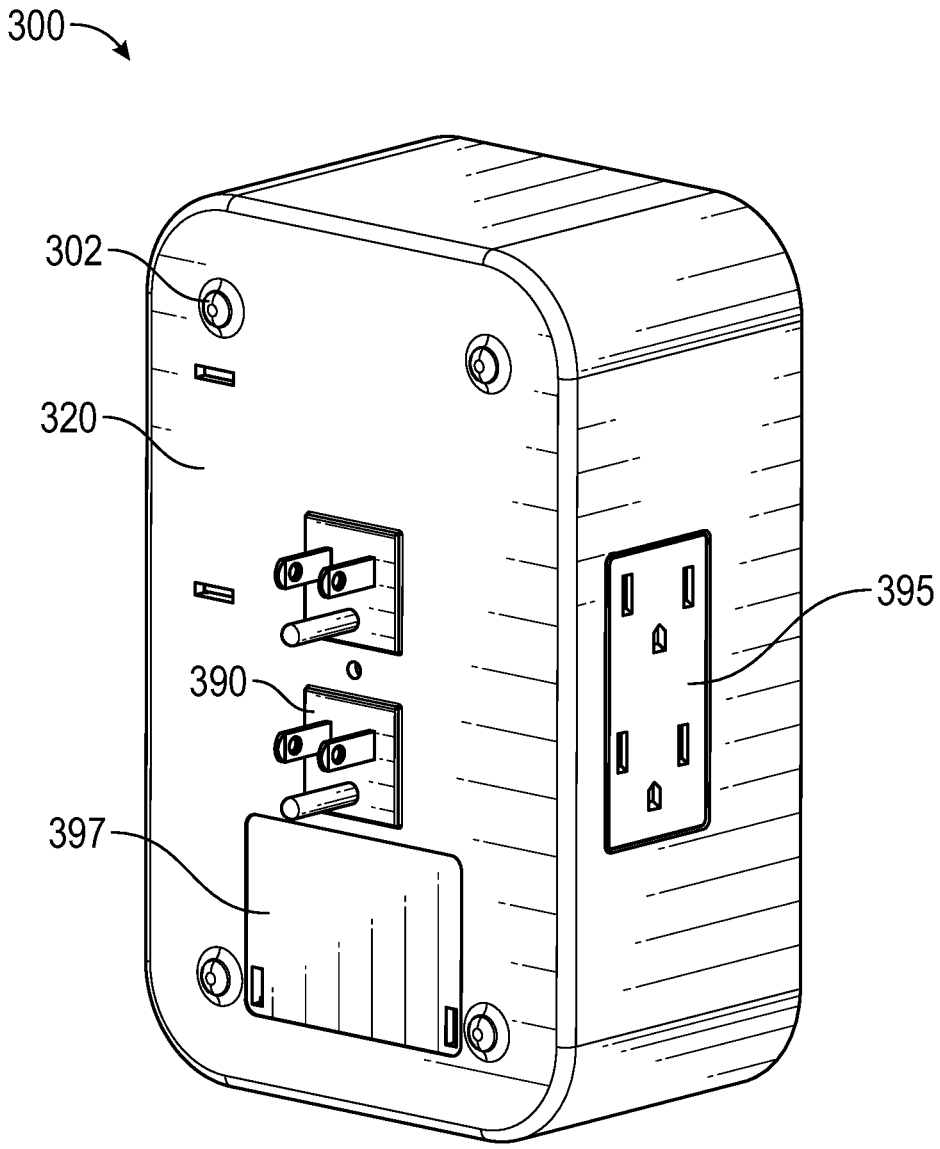
FIG. 16 is a rear side perspective view of the air purification unit shown in FIG. 15.

FIG. 16 illustrates a rear angle view of the air purifier unit, showing the back panel 320. The back panel is configured for mounting against a flat structural surface such as a wall or ceiling using one of four attachment holes 302. These holes may be accessed from the inside of the air purification unit 300, and common screws may be used to fix the air purification unit in place. In the illustrated embodiment, the unit is mounted over the top of a common electrical outlet, and the unit is equipped with one or two wall plugs 390 that fit into the outlet. In some cases, for smaller embodiments such as that shown, the unit 300 may remain in place simply through retention of the plugs 390 in the socket (not shown) such that screws and holes 302 are not used.

The purpose of having two plugs 390 is to allow access to electricity for other devices despite the outlet being fully covered by the device. That is, one of the plugs 390 is used to receive power to operate the air purifier unit 300, while the other plug 390 connects power to the pass through socket 395 on the side of the unit 300. This pass through socket 395 is then available for use by other devices. Air purifier unit 300 may also be equipped with batteries to power the device during times of electrical failure. As shown a battery compartment cover 397 conceals where the batteries could be installed.

Figure 17:
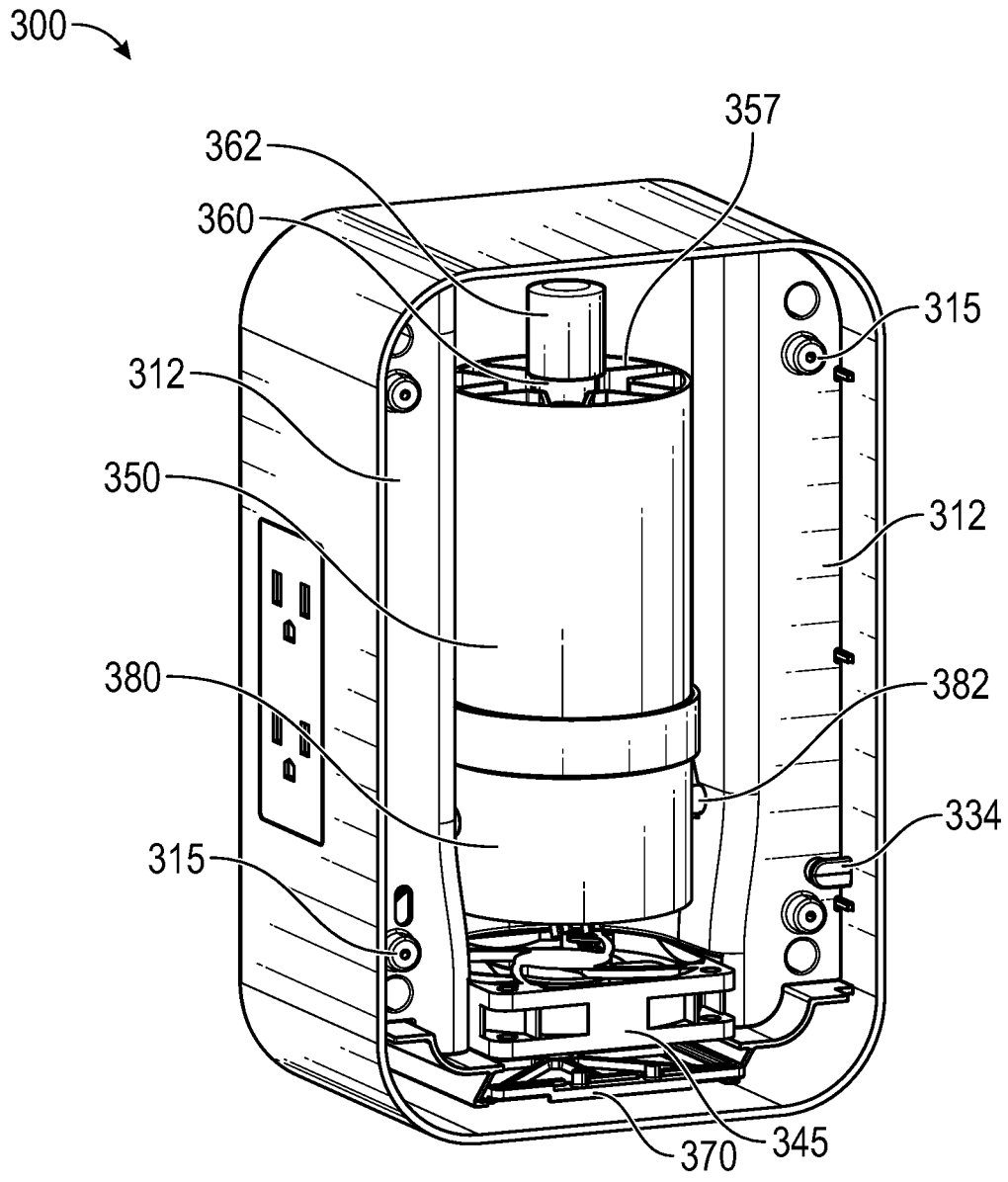
FIG. 17 is a front side perspective view of the air purification unit of FIG. 15 with the front cover removed and the internal components in an operating condition.

FIG. 17 shows certain internal components of the air purification unit 300, also referred to herein as the "wall unit." As will be seen, many of these internal components are similar to or the same as internal components of the previously disclosed purification unit in FIGS. 1-14, such that the parts may even be interchangeable. At the bottom near where air enters the intakes 317 is an air filter assembly 370. This air filter assembly may have the same basic components and structure as previously-disclosed air filter assembly 170, so it will not be revisited here. Like air filter assembly 170, air filter assembly 370 is removable and may be replaced or cleaned. Just above air filter assembly 370 is fan housing 345. This fan housing is similar to, and may be interchangeable with, fan housing 145 of the previously-disclosed embodiment. As shown, it is positioned between the forward panels 312 within the unit 300 so that air is generally directed up through the fan assembly 340 toward the core assembly 350 above.

Once through the fan, air is directed up through a harness 380, which has a perforated bottom and is used to mount the core assembly 350. Core assembly 350 can be interchangeable with core assembly 150 of the mobile unit 100. That is, it features a sleeve 352 that contains an ionization cell 357 having a quad-metallic catalyst coating on an inner surface, troughs and ridges, and seams that allow it to fold around a UV light source. While the size and dimensions of these components may vary, the same description provided in association with FIGS. 6-8 above applies to the core assembly 350 of the wall unit 300. In addition, the bulb 360 is of the same variety as bulb 160. That is, it has opaque top and bottom caps (362, 361) and a central glass or plastic piece that is translucent, allowing the UV Light to pass through and interact with the catalyst of the ionization cell 357 wrapped around it. At bottom of the light 360 are connector pins 363 that plug into a light receptacle 346, with wiring leading to the electrical source.

Figure 18:
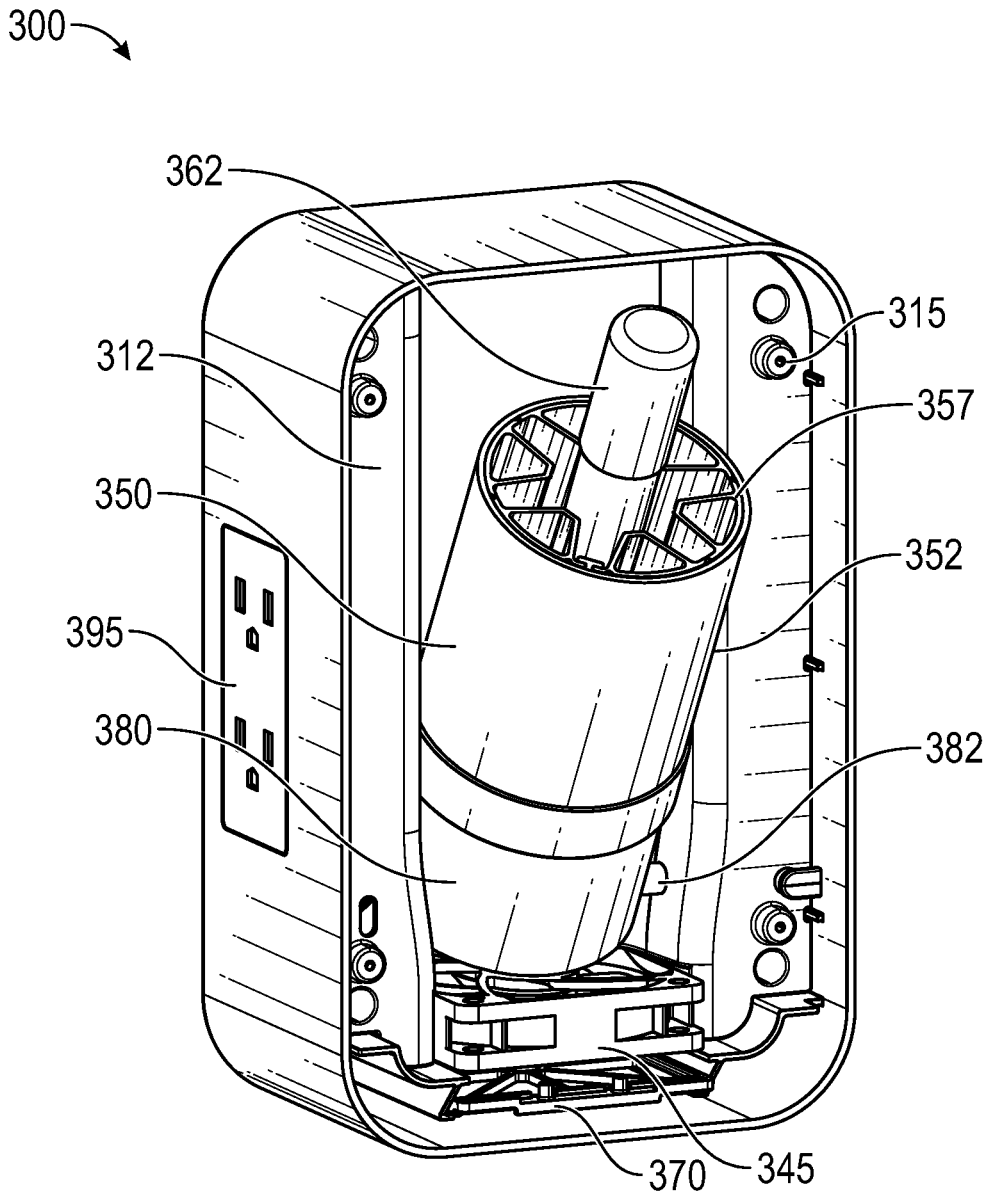
FIG. 18 is a front side perspective view of the air purification unit of FIG. 15 with the front cover removed and the internal components in a service position.
Figure 19:
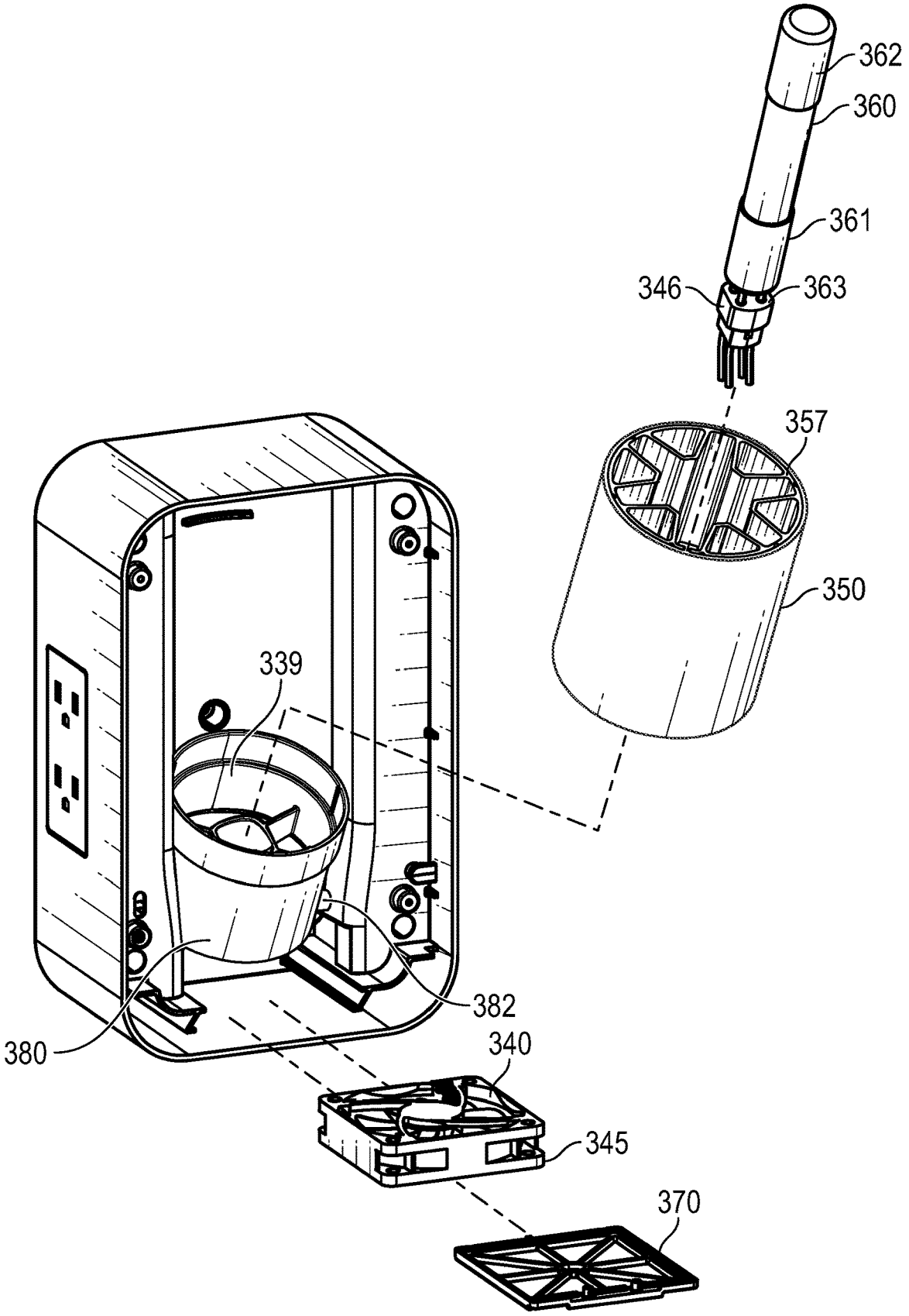
FIG. 19 is an exploded view of the air purification unit of FIG. 18 showing certain components extended out from the unit.

A key difference between the mobile unit and the wall unit is the presence and function of harness 380. With the mobile unit, there is no upper blockage when the outer cover 120 is removed. However, even when face plate 310 is removed, the bulb 360 and ionization cell 357 may not be removed for servicing or replacement because the top panel of the unit 300 is still in the way. To overcome this, wall unit 300 features harness 380, which takes the place of the fixed core assembly housing 139 of the mobile unit. Instead, as shown in FIG. 19, the harness 380 provides a core assembly housing 339, and the entire harness 380 may be rotate outward of the wall unit structure along axle 382 such that the core assembly 350 and bulb 360 may be removed. FIG. 18 shows the same view as FIG. 17 with the face plate 310 removed, but the harness 380 in FIG. 18 has been rotated out to illustrate this. FIG. 19 shows the view of FIG. 18, but with the core assembly 350 and the bulb 360 exploded out to reveal the hollow bottom of the harness 380 through which air passes through from the fan assembly 340 below.

Though not shown, wall air purifier unit 300 is equipped with a circuit board, motor, and electrical switches connected to the fan assembly 340 and the UV bulb 360 just as in the previously-disclosed mobile unit 100. However, it will be understood that different motor and circuit board geometries could be designed or selected to fit within the different physical space provided. Also, the wall unit 300 can utilize a pressure switch 334 that operates like the safety catch 134 of the mobile unit 100. That is, when the face plate 310 is removed from the unit, the pressure switch 334 is released, which opens a switch and shuts off the flow of electricity to the bulb 360 so as to prevent external exposure to ultraviolet light from the bulb 360.

Though a reasonably compact wall unit is disclosed, the size of the wall unit is easily scaled. For example, while still using the same size bulb 360, core assembly 350 and harness 380, a number of these components could be positioned side by side, each with individual fan assemblies 340 and air filters 370 underneath them, separated by structure similar to forward panels 312 to create independent air flow paths through each modular unit. A number of these could be positioned side by side within a longer panel wall unit to effectively cleans a much larger open area.

Those skilled in the mechanical arts will appreciate that various changes may be made and equivalents may be substituted without departing from the scope of systems and methods disclosed in this application. For example, the air purification units can take other exterior physical shapes without departing from the internal components of the present invention discussed herein. As mentioned, the unit may be scaled to handle larger or smaller volumes of air. The order of the fan, air filter and light bult/ionization cell combination can be in any order so long as they are positioned between an air inlet and an air outlet, and a generally closed channel is provided for air to pass from inlet to outlet. Various cell geometries could also be used without departing from the spirit of the invention, the general effort being to maximize the exposed surface area while minimizing distance to the ultraviolet light source. The quad metallic catalyst coating could be varied in several respects such as parts per million and ratio of metals so long as it still produces the charged ions to inspire oxidation. The selection of materials for the physical components of the device may be altered based on cost, appearance, and durability requirements. Thus, it is intended that the novel techniques of the present invention not be limited to the particular embodiments explicitly disclosed, but that they include all techniques falling within the scope of the appended claims.

What is claimed is:

1. An air purification unit comprising:

an ultraviolet light source;

an ionization cell having an inner surface coated with a catalyst, the inner surface forming a series of ridges and troughs wherein each trough has at least one foldable seam that allows the ionization cell to fold at least partially around the ultraviolet light source, the ionization cell further comprising a first edge and a second edge, and wherein, in an unfolded position of the ionization cell, the first edge is facing away from the second edge, while, in a folded position of the ionization cell, the first edge is facing toward the second edge;

a rigid sleeve, wherein the ionization cell may be slid into the rigid sleeve only when the ionization cell is in the folded position, the rigid sleeve having an inner surface that forms a rib, and wherein the first edge and the second edge fit up against the rib when the ionization cell is slid into the rigid sleeve; and a fan assembly positioned to create an airflow along at least the inner surface of the ionization cell.

2. The air purification unit of claim 1, wherein the ionization cell is configured to substantially surround a circular perimeter of the ultraviolet light source such that the ridges extend closer to the light source and the troughs extend further from the light source.

3. The air purification unit of claim 1 further comprising:

a base structure that houses the fan assembly; and a substantially opaque removable cover configured to fit against the base structure;

wherein, when the substantially opaque removable cover is in an installed position, the substantially opaque removable cover and the base structure collectively surround the ultraviolet light source and the ionization cell.

4. The air purification unit of claim 3, wherein the substantially opaque outer cover comprises an open bottom end that allows air intake to the fan assembly and a top end with at least one opening to allow air to escape the air purification unit after passing through the ionization cell.

5. The air purification unit of claim 3 further comprising a switch that controls the flow of electric power to the ultraviolet light source, wherein the switch is configured to only direct electric power to the ultraviolet light source when the substantially opaque outer cover is in the installed position.

* * * * *